US005155886A

United States Patent [19]

Schrader et al.

[11] Patent Number: 5,155,886

[45] Date of Patent: Oct. 20, 1992

[54] GRID AND CYLINDER AIR WASH BAFFLE WALL FOR LINT CLEANER

[75] Inventors: Kenneth D. Schrader, Shallowater; James A. Nichols, Lubbock, both of Tex.

[73] Assignee: Texoma Machine, Inc., Shallowater, Tex.

[21] Appl. No.: 728,548

[22] Filed: Jul. 11, 1991

[51] Int. Cl.[5] ..... D01B 1/08

[52] U.S. Cl. ..... 19/202; 19/205

[58] Field of Search ..... 19/39, 44, 48 R, 55 R, 19/58, 59, 63, 64, 64.5, 107, 200, 202, 203, 204, 205, 41, 42, 61

[56] References Cited

U.S. PATENT DOCUMENTS

| | | | |
|---|---|---|---|
| 469,559 | 2/1892 | Groom | 19/59 |
| 910,653 | 6/1909 | Epps | 19/59 |
| 1,086,204 | 2/1914 | Murray | 19/59 |
| 1,124,094 | 1/1915 | Wooldridge | 19/58 |
| 1,168,493 | 1/1916 | Ginn | 19/59 |
| 1,201,901 | 10/1916 | West | 19/58 |
| 1,350,439 | 8/1920 | Davidson | 19/205 X |
| 1,401,439 | 12/1921 | Pettit | 19/63 |
| 2,738,553 | 3/1956 | Davis, Jr. | 19/41 |
| 2,834,057 | 5/1958 | Raynor | 19/55 |
| 2,867,850 | 1/1959 | Mayer, Jr. et al. | 19/58 |
| 2,934,793 | 5/1960 | Kotter et al. | 19/58 |
| 2,948,022 | 8/1960 | Day | 19/203 |
| 3,121,921 | 2/1964 | Latour | 19/203 |
| 3,163,889 | 1/1965 | Wallace | 19/58 X |
| 3,388,434 | 6/1968 | Calhoun, Jr. | 19/203 |
| 4,313,242 | 2/1982 | Salmon | 19/55 R |
| 4,520,529 | 6/1985 | Davis | 19/41 |
| 4,528,725 | 7/1985 | Horn et al. | 19/200 |
| 4,631,781 | 12/1986 | Shofner | 19/200 |
| 4,723,342 | 2/1988 | Strother et al. | 19/40 |

FOREIGN PATENT DOCUMENTS

| | | | |
|---|---|---|---|
| 1305203 | 4/1987 | U.S.S.R. | 19/55 R |

*Primary Examiner*—Werner H. Schroeder
*Assistant Examiner*—Ismael Izaguirre
*Attorney, Agent, or Firm*—Jacobson, Price, Holman & Stern

[57] ABSTRACT

An arcuate baffle wall is provided within a conventional lint cleaner forward of and horizontally registered with the front side of the saw cylinder of the lint cleaner. The upper and lower extremities of the baffle wall are generally horizontally registered with the upper and lower extremities of the saw cylinder and the baffle wall is spaced generally midway between the forward periphery of the saw cylinder and the front wall section of the lint cleaner to thereby define a venturi passage for air flow at appreciably increased velocity downward over the grid bars of the lint cleaner spaced about the forward peripheral portion of the saw cylinder. The venturi passage greatly increases the velocity of air flow past the grid bars and prevents the build up of cotton lint thereon to the extent that tangential outward displacement of dirt from the saw cylinder is blocked.

7 Claims, 2 Drawing Sheets

GRID AND CYLINDER AIR WASH BAFFLE WALL FOR LINT CLEANER

BACKGROUND OF THE INVENTION

1. Field of the Invention

This invention relates to a lint cleaner which has been modified to reduce, by substantially one-half, the front-to-rear depth of the air flow path within the lint cleaner past the several grid bars and saw cylinder thereof, with the reduced depth air passage serving to greatly increase the velocity of air flow through the passage and to thereby "air wash" the grid bars as well as the adjacent forward periphery of the saw cylinder to prevent the build up of lint on the grid bars, which build up interferes with generally tangential discharge of trash from the saw cylinder and allows the once removed trash to build up on the side of the lint build up opposing the saw cylinder. After sufficient lint has built up on the grid bars, the trash tends to be sucked back into the saw cylinder and, therefore, is remixed with the cotton lint on the saw cylinder doffed from the saw cylinder by the brush cylinder.

2. Description of Related Art

Various different forms of lint cleaners heretofore have been provided such as those disclosed in U.S. Pat. Nos. 469,559, 910,653, 1,086,204, 1,124,094, 1,168,493, 1,201,901, 2,738,553, 2,834,057, 2,867,850, 2,934,793, 3,121,921, 4,520,529, 4,528,725 and 4,631,781. However, some of these lint cleaners do not include the equivalent of coacting saw cylinders and grid bars and others do not include structure whereby a reduced depth venturi-type throat is provided for passage of air past the several grid bars and the adjacent side of the associated saw cylinder.

SUMMARY OF THE INVENTION

The lint cleaner of the instant invention comprises a modification of a conventional multi-grid bar and saw cylinder equipped lint cleaner of the type including a front wall (having a removable door therein) spaced generally 12 inches forward of the outer periphery of a 16 inch diameter saw cylinder having multiple (in most cases five) grid bars spaced about the forward periphery of the saw cylinder between approximately the 7 and 11 O'clock positions thereof with the grid bars spaced only slightly outwardly of the forward periphery of the saw cylinder. In addition, the conventional lint cleaner includes a mote hopper having a transverse width substantially equal to the length of the saw cylinder and which includes a front-to-rear depth of approximately 15 inches with the forward side of the mote hopper forming a downward continuation of the front wall of the lint cleaner cabinet.

The instant invention includes the provision of a baffle wall (having a door therein) mounted within the lint cleaner cabinet generally one-half the distance between the forward outer periphery of the saw cylinder and the front wall of the cabinet and with the lower portion of the baffle wall being generally vertically disposed and aligned with the front side of a modified mote hopper inlet end spaced approximately 8 inches rearward from the front wall of the hopper, the baffle wall and the reduced front-to-rear depth of the mote hopper serving to accelerate the flow of air past the forward side of the saw cylinder and the grid bars associated therewith, which accelerated air flow prevents the build up of lint on the grid bars.

By substantially eliminating the build up of lint on the grid bars, the small remaining bits of trash to be removed from the cotton lint as it is fed to the saw cylinder is separated from the lint by the saw cylinder and thrown outward between the grid bars, thus preventing the build up of small particles of trash on the side of a lint build up on the grid bars facing the saw cylinder. It has been discovered such trash build up results in a portion of the trash build up being drawn back into the saw cylinder for contamination of the lint being carried thereby, afterwhich the contaminated lint is doffed from the saw cylinder by the brush cylinder. Accordingly, the grid bar air wash system of the instant invention enables the associated lint cleaner to more effectively clean the lint and thus reduce the necessity of lint being passed through tandem lint cleaners.

The main object of this invention is to provide a lint cleaner including structure which will greatly increase the velocity of air flow downwardly along the front side of the saw cylinder opposed by the plurality of associated grid bars and over the latter.

Still another object of this invention is provide a lint cleaner which will direct a larger portion of high velocity air past the three uppermost grid bars and with a major portion of the air flow directed upon the uppermost grid bar.

Yet another object of this invention is to provide a lint cleaner modification in accordance with the preceding objects and which may be readily incorporated into existing lint cleaners.

Another object of this invention is to provide an improved cleaning action lint cleaner which will effect a more thorough cleaning action on lint and thus greatly reduce the necessity of passing cotton through tandem lint cleaners.

A final object of this invention to be specifically enumerated herein is to provide an improved lint cleaner for cotton which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
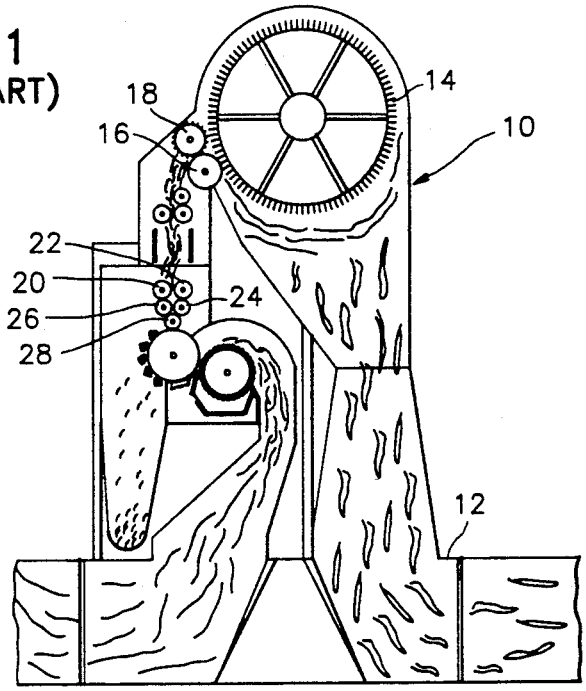
FIG. 1 (PRIOR ART)
FIG. 1 is a fragmentary schematic view illustrating a lint cleaner of conventional design disposed in tandem with at least one other lint cleaner.

Referring now more specifically to the drawings the numeral 10 generally designates a conventional form of cotton lint cleaner comprising one lint cleaner connected in series with at least one other lint cleaner. Cotton partially cleaned by a first lint cleaner enters the lint cleaner 10 at 12 and adheres to a revolving screen 14. As the screen 14 rotates the cotton thereon is compressed by the woodroller 16 to a bat approximately ¾ inch thick and the cotton is then doffed off the screen 14 by a roller 18 and passes between the woodroller 16 and the roller 18 downwardly between rollers 20 and 22 and then between rollers 24 and 26 for compression into a bat of cotton approximately ¼ inch thickness. The bat of cotton then travels between the feed roller 28 and the feed bar 30 and is compressed to a thickness of 0.010 inch, afterwhich the cotton bat is passed to the saw cylinder 32.

The peripheral speed of the saw cylinder 32 is much greater than the speed of the cotton bat delivered to the saw cylinder 32 and, accordingly, the saw cylinder 32 performs a combing action on the cotton which pulls cotton fibers away from the bat. This in turn allows trash within the cotton fibers and other foreign material to be slung out of the cotton by centrifugal force. The trash then hits the grid bars 34, 36, 38, 40 and 42 and is transferred radially outwardly of the saw cylinder 32 beyond the grid bars. The cotton fibers cling to the saw cylinder and are doffed from the saw cylinder by the brush cylinder 44, afterwhich the cotton lint is then carried away from the lint cleaner 10 and compressed into a marketable bale of cotton, or is passed through a second lint cleaner before being compressed into a bale of cotton.

The above description comprises a description of the structure and operation of a conventional lint cleaner wherein air enters the cabinet of the air cleaner 10 through protective bars 46 and travels through the lint cleaner 10 along the path designated by the arrows 48 before passing into the mote hopper 50 with which an exhaust blower (not shown) is operatively associated.

The forward portion of the cabinet of the lint cleaner 10, in horizontal registry with the grid bars 34, 36, 38, 40 and 42, is provided with a removably mounted access door 52 through which access may be gained to the area of the grid bars.

In a conventional lint cleaner such as the lint cleaner 10 cotton fibers which are not carried about the saw cylinder tend to collect on the grid bars 34, 36, 38, 40 and 42 to a great extent and these collected cotton fibers gradually form bats of cotton fibers which obstruct the openings between the grid bars through which trash is designed to be thrown. When these bats of cotton fiber build up on the grid bars 34–42, the trash thrown outward from the saw cylinder 32 collects on the faces of the cotton bats formed on the grid bars and thus builds up thereon to the extent that some of the trash thrown outward from the saw cylinder is drawn back there toward and into the cotton fibers passing around the saw cylinder and being doffed therefrom by the brush cylinder 44. Thus, the cotton lint (which is to have been cleaned by the saw cylinder 32) is recontaminated with trash and, accordingly, the cotton lint doffed from the saw cylinder 32 by the brush cylinder 44 is not as clean as it should be. Therefore, it is not unusual for multiple lint cleaners 10 to be connected in tandem.

Figure 3:
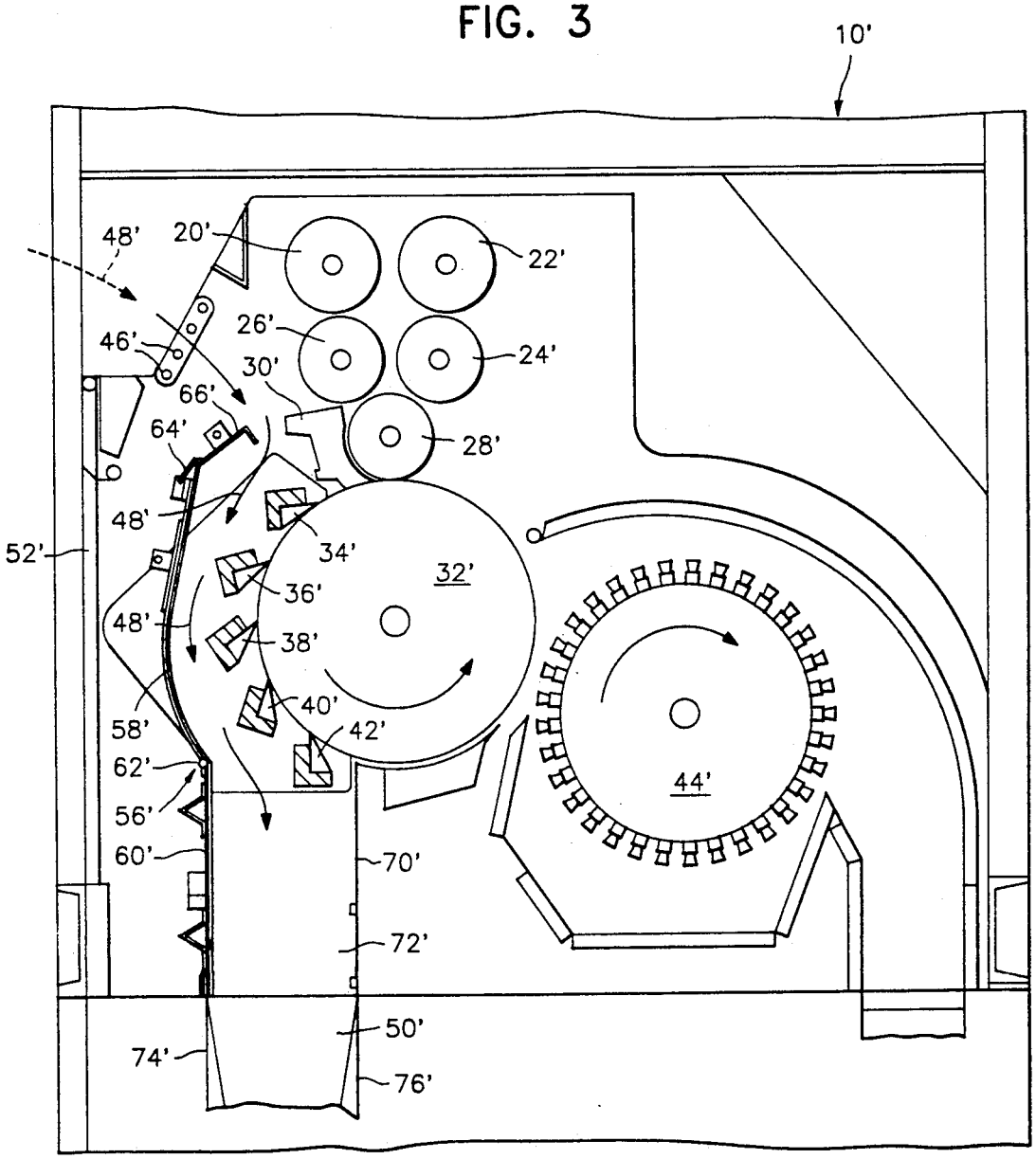
FIG. 3 is a fragmentary schematic view of a conventional lint cleaner modified in accordance with the present invention.

Referring now more specifically to FIG. 3 of the drawings, the numeral 10' generally designates a lint cleaner which has been modified in accordance with the present invention. Various portions of the lint cleaner 10' corresponding to the similar portions of the lint cleaner 10 above described are referred to by corresponding prime numerals. Further, as in the case with the lint cleaner 10, air enters and passes through the lint cleaner 10' along the path indicated by the arrows 48' for movement from the machine 10' through the mote hopper 50'.

The modified lint cleaner 10' may retain the removable front door 52' thereof, or the front door 52' may be removed. However, a baffle wall referred to in general by the reference numeral 56' is installed within the lint cleaner 10' and extends the full length along the saw cylinder 32' with the baffle wall 56' including an arcuate upper section 58' and a vertical lower section 60', the lower section 60' being stationary and the upper section 58' being hingedly supported from the lower section 60' as at 62'. Further, a latch assembly 64' is provided on the upper section 58' for latching the upper section 58' to a stationary transverse brace 66'. The upper section 58' therefore constitutes an access door extending between the lower section 60' and the brace 66'.

The mid and lower portions of the upper section 58' extend along an arc which has its center of curvature generally coinciding with the axis of rotation of the saw cylinder 32' but the upper portion of the upper section 58' is substantially planar and diverges away from those peripheral portions of the saw cylinder 32' horizontally registered therewith. The path of entry of air into the lint cleaner 10' passes in back of the brace 66' and thus the stream of air passing through the lint cleaner 10' is initially directed downwardly upon the uppermost grid bar 34' and thereafter downwardly along the grid bars 36'–42'. Also it will noted that the upper section 58 is disposed generally midway between the removable front door 52' and the forwardmost periphery of the saw cylinder 32'. Thus, the cross sectional area of the flow path 48' of air past the saw cylinder 32' and the grid bars 34'–42' is reduced by generally 50% from the cross section of the air flow path 48 passing through the unmodified lint cleaner 10. In this manner, the air moving along the flow path 48' in not only increased in speed by generally 100%, but it is also directed initially downwardly upon the uppermost grid bar 34'. This increase in air flow velocity, with the same capacity exhaust blower (now shown) operatively associated with the mote hopper 50', ensures that the build up of cotton line bats on the grid bars 34'–42' will be nonexistent, or at least minimal, and that if any lint build up occurs such lint build up will not be sufficient to block outward discharge of trash from the saw cylinder.

Figure 2:
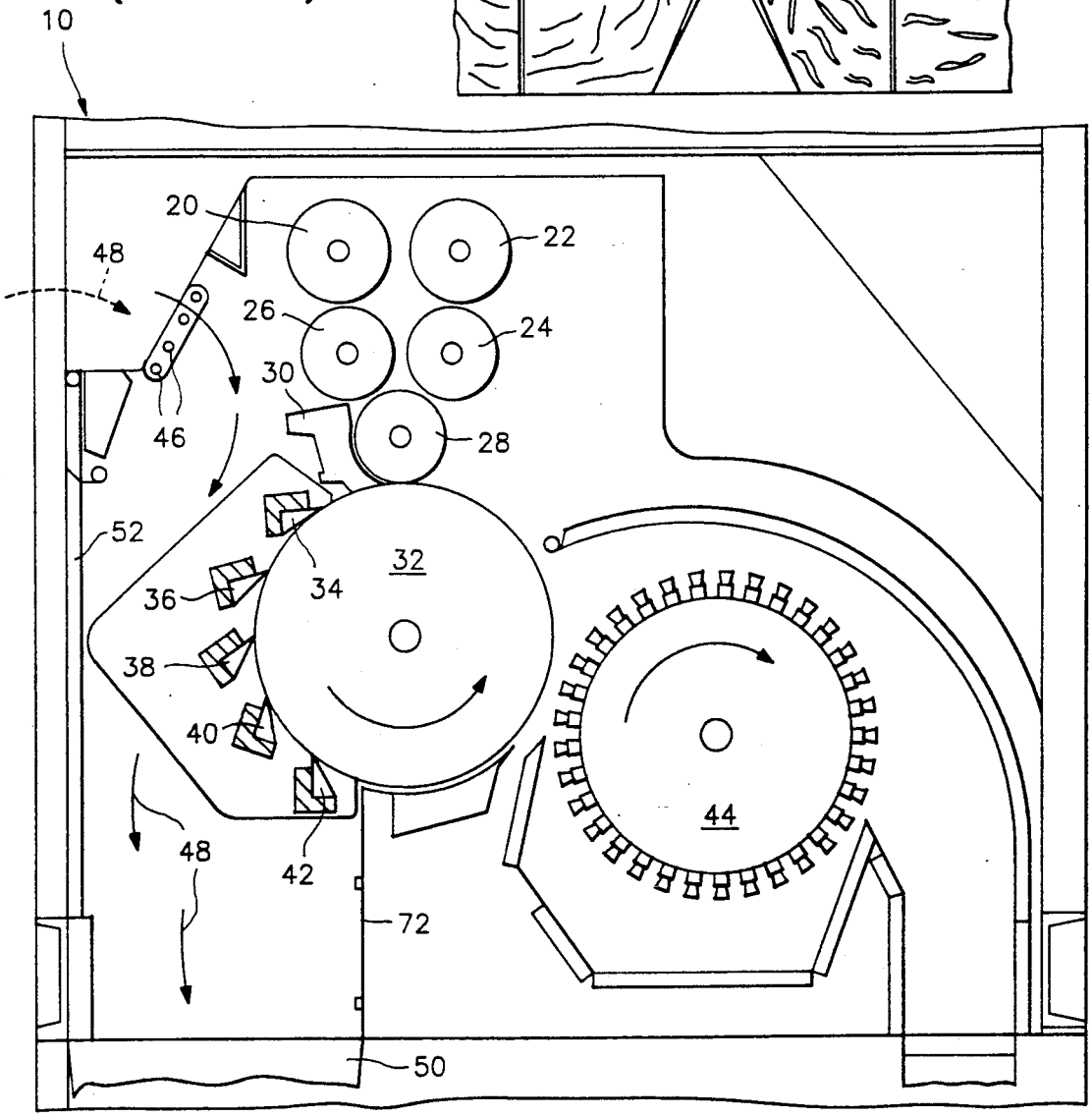
FIG. 2 (PRIOR ART)
FIG. 2 is an enlarged fragmentary schematic view of the conventional lint cleaner.

The lower section 60' is disposed generally one-half the distance from the front of the lint cleaner 10 to the rear wall 70' of the duct 72' opening down into the mote hopper 50', the front wall 74' of the mote hopper 50' also being disposed approximately one-half the distance between the front of the lint cleaner 10 and the rear wall portion 76' of the mote hopper 50. Accordingly, the duct 72' has generally one-half the cross sectional flow area of the duct 72 on the lint cleaner 10 (see FIG. 2) and the mote hopper 50' has generally one-half the cross sectional area of flow of the mote hopper 50 illustrated in FIG. 2. The reduction in size of the duct 72' and the mote hopper 50' from the size of the duct 72 and the mote hopper 50 ensures that the increased air flow velocity immediately rearward of the upper section 58' is maintained throughout movement of the air flow downwardly through the lint cleaner 10 and to the associated exhaust blower (not shown).

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A method for modifying a lint cleaner having grid bars and a saw cylinder, for improving an air washing of said bars and said saw cylinder, wherein said saw cylinder is spaced from a front wall section of the cleaner, and wherein the cleaner further includes a mote hopper having a mote hopper upper inlet end with a predetermined inlet dimension disposed beneath and opening upwards toward a forward periphery of the saw cylinder facing an inner surface of the front wall section along said inner surface of said front wall section and, the grid bars include a plurality of stationary grid bars spaced about and extending lengthwise along the forward periphery of said saw cylinder in close proximity thereof, said modification including: installing an upstanding baffle wall in said lint cleaner generally midway between said forward periphery and said front wall section with said baffle wall extending along and generally paralleling said saw cylinder and defining, an upper extremity generally horizontally aligned with an upper forward periphery of said saw cylinder, a middle portion generally horizontally aligned with a horizontal mid-forward portion of said saw cylinder, a lower extremity generally horizontally aligned with a lower forward periphery of said saw cylinder, and wherein said middle portion forms a venturi passage including a minimum cross sectional area generally horizontally aligned with said mid-forward portion of said saw cylinder, and replacing said mote hopper with a replacement mote hopper having an inlet dimension generally one-half said predetermined dimension and providing a substantially sealed communication between said inlet and said lower extremity of said baffle wall.

2. The method of claim 1 wherein said the lower extremity of the baffle wall includes a downward extension and said replacement mote hopper includes a front wall portion spaced from of said front wall section disposed generally coextensive with said baffle wall downward extension.

3. The method of claim 1 wherein said baffle wall is generally arcuate in shape and is of a radius of curvature generally equal to a spacing of said baffle wall forward of the axis of rotation of said rotary saw cylinder.

4. In combination with a lint cleaner including a rotary saw cylinder spaced from a front wall section of said cleaner, a plurality of grid bars spaced about and extending lengthwise along a forward periphery of said saw cylinder, facing said front wall section in close proximity thereto, an upstanding baffle wall in said lint cleaner disposed generally midway between said forward periphery and said front wall section and extending along and generally paralleling said saw cylinder and defining, an upper extremity generally horizontally aligned with an upper forward periphery of said saw cylinder, a middle portion generally horizontally aligned with a horizontal mid-forward portion of said saw cylinder, a lower extremity generally horizontally aligned with a lower forward periphery of said saw cylinder, and wherein said middle portion forms a venturi passage including a minimum cross sectional area generally horizontally aligned with said mid-forward portion of said saw cylinder, an upstanding duct having an upper end sealingly communicated with a lower extremity of said venturi passage, and an upwardly opening mote hopper sealing communicated with a lower end of said duct, said duct and said upper end of said mote hopper having an effective cross sectional area substantially equal to an effective cross sectional area of said lower extremity of said venturi passage.

5. The lint cleaner of claim 4 wherein said upstanding baffle wall is generally arcuate in shape with its radius of curvature generally equal to a spacing of said baffle wall forward of the axis of rotation of said saw cylinder.

6. The line cleaner of claim 5 wherein said lower extremity of said baffle wall is hingedly supported by the upper end of said duct for forward and backward swinging of the upper extremity of said baffle wall for access to said grid bars from a position disposed forward of said lint cleaner front wall section.

7. The lint cleaner of claim 6 wherein said front wall section includes a removable door horizontally aligned with said baffle wall.

* * * * *